US010640841B2

(12) United States Patent
Kimura et al.

(10) Patent No.: US 10,640,841 B2
(45) Date of Patent: May 5, 2020

(54) HIGH-STRENGTH, HIGH-TOUGHNESS STEEL PLATE AND METHOD FOR PRODUCING THE SAME

(71) Applicant: JFE STEEL CORPORATION, Tokyo (JP)

(72) Inventors: Hideyuki Kimura, Kawasaki (JP); Kyono Yasuda, Fukuyama (JP); Nobuyuki Ishikawa, Kawasaki (JP)

(73) Assignee: JFE STEEL CORPORATION, Tokyo (JP)

( * ) Notice: Subject to any disclaimer, the term of this patent is extended or adjusted under 35 U.S.C. 154(b) by 147 days.

(21) Appl. No.: 15/562,192

(22) PCT Filed: Mar. 25, 2016

(86) PCT No.: PCT/JP2016/001744
§ 371 (c)(1),
(2) Date: Sep. 27, 2017

(87) PCT Pub. No.: WO2016/157863
PCT Pub. Date: Oct. 6, 2016

(65) Prior Publication Data

US 2018/0057908 A1 Mar. 1, 2018

(30) Foreign Application Priority Data

Mar. 31, 2015 (JP) ..... 2015-071932

(51) Int. Cl.

| | |
|---|---|
| ***C21D 9/46*** | (2006.01) |
| ***C22C 38/58*** | (2006.01) |
| ***C22C 38/00*** | (2006.01) |
| ***C21D 8/02*** | (2006.01) |
| ***C21D 1/18*** | (2006.01) |
| ***C21D 6/00*** | (2006.01) |
| ***C22C 38/02*** | (2006.01) |
| ***C22C 38/06*** | (2006.01) |
| ***C22C 38/08*** | (2006.01) |
| ***C22C 38/16*** | (2006.01) |
| ***C22C 38/22*** | (2006.01) |
| ***C22C 38/26*** | (2006.01) |
| ***C22C 38/28*** | (2006.01) |
| ***C22C 38/38*** | (2006.01) |

(52) U.S. Cl.

CPC ..... *C21D 9/46* (2013.01); *C21D 1/18* (2013.01); *C21D 6/001* (2013.01); *C21D 6/002* (2013.01); *C21D 6/005* (2013.01); *C21D 6/008* (2013.01); *C21D 8/02* (2013.01); *C21D 8/0205* (2013.01); *C21D 8/0263* (2013.01); *C22C 38/00* (2013.01); *C22C 38/001* (2013.01); *C22C 38/002* (2013.01); *C22C 38/005* (2013.01); *C22C 38/02* (2013.01); *C22C 38/06* (2013.01); *C22C 38/08* (2013.01); *C22C 38/16* (2013.01); *C22C 38/22* (2013.01); *C22C 38/26* (2013.01); *C22C 38/28* (2013.01); *C22C 38/38* (2013.01); *C22C 38/58* (2013.01); *C21D 2211/001* (2013.01); *C21D 2211/002* (2013.01); *C21D 2211/008* (2013.01)

(58) Field of Classification Search

CPC ..... C21D 9/46; C21D 6/002; C21D 6/005; C21D 6/008; C21D 8/0205; C21D 8/0226; C21D 8/0263; C22C 38/00; C22C 38/001; C22C 38/002; C22C 38/005; C22C 38/02; C22C 38/04; C22C 38/06; C22C 38/08; C22C 38/12; C22C 38/14; C22C 38/16; C22C 38/20; C22C 38/22; C22C 38/26; C22C 38/28; C22C 38/38; C22C 38/42; C22C 38/44; C22C 38/46; C22C 38/48; C22C 38/50; C22C 38/54; C22C 38/58

USPC ..... 148/504

See application file for complete search history.

(56) References Cited

U.S. PATENT DOCUMENTS

| | | | |
|---|---|---|---|
| 8,177,925 | B2 | 5/2012 | Takahashi et al. |
| 9,181,609 | B2 | 11/2015 | Ishikawa et al. |
| 2012/0285576 | A1 | 11/2012 | Nishimura et al. |

(Continued)

FOREIGN PATENT DOCUMENTS

| | | | |
|---|---|---|---|
| CA | 2775031 | A1 | 4/2011 |
| CN | 1918308 | A | 2/2007 |

(Continued)

OTHER PUBLICATIONS

Extended European Search Report for European Application No. 16771751.1, dated Jan. 5, 2018, 4 pages.

(Continued)

*Primary Examiner* — Anthony J Zimmer
*Assistant Examiner* — Ricardo D Morales
(74) *Attorney, Agent, or Firm* — Ratnerprestia

(57) ABSTRACT

A high-strength, high-toughness steel plate having excellent surface properties and a high absorbed energy includes, by mass %, C: 0.03% to 0.08%, Si: 0.01% to 0.50%, Mn: 1.5% to 2.5%, P: 0.001% to 0.010%, S: 0.0030% or less, Al: 0.01% to 0.08%, Nb: 0.010% to 0.080%, Ti: 0.005% to 0.025%, and N: 0.001% to 0.006%, and further includes at least one selected from Cu: 0.01% to 1.00%, Ni: 0.01% to 1.00%, Cr: 0.01% to 1.00%, Mo: 0.01% to 1.00%, V: 0.01% to 0.10%, and B: 0.0005% to 0.0030%, with the balance being Fe and unavoidable impurities. In a surface portion and a central portion in the thickness direction, the area fraction of Martensite-Austenite constituent is less than 3% and the area fraction of bainite is 90% or more, and in the central portion in the thickness direction, the average particle size of cementite in bainite is 0.5 μm or less.

4 Claims, No Drawings

(56) References Cited

U.S. PATENT DOCUMENTS

| | | | | |
|---|---|---|---|---|
| 2012/0305122 | A1* | 12/2012 | Ishikawa | B23K 9/0282 138/177 |
| 2013/0000793 | A1 | 1/2013 | Ishikawa et al. | |
| 2014/0301888 | A1 | 10/2014 | Ichikawa et al. | |
| 2015/0090370 | A1 | 4/2015 | Shimamura et al. | |
| 2015/0176727 | A1 | 6/2015 | Tanizawa et al. | |

FOREIGN PATENT DOCUMENTS

| | | | |
|---|---|---|---|
| CN | 102666899 | A | 9/2012 |
| CN | 102906291 | A | 1/2013 |
| EP | 1764423 | A1 | 3/2007 |
| EP | 1870484 | A1 | 12/2007 |
| EP | 2119803 | A1 | 11/2009 |
| EP | 2505681 | A1 | 10/2012 |
| EP | 2505682 | A1 | 10/2012 |
| EP | 2546375 | A1 | 1/2013 |
| EP | 2832890 | A1 | 2/2015 |
| JP | 2003096517 | A | 4/2003 |
| JP | 2006257499 | A | 9/2006 |
| JP | 2009242849 | A | 10/2009 |
| JP | 2010222681 | A | 10/2010 |
| JP | 2011132600 | A | 7/2011 |
| JP | 2011132601 | A | 7/2011 |
| JP | 2011195883 | A | 10/2011 |
| JP | 2012241266 | A | 12/2012 |
| JP | 2012241267 | A | 12/2012 |
| JP | 2013057125 | A | 3/2013 |
| JP | 2013095926 | A | 5/2013 |
| JP | 2013133476 | A | 7/2013 |
| JP | 2013139628 | A | 7/2013 |
| JP | 2013204103 | A | 10/2013 |
| JP | 2013204103 | A * | 10/2013 |
| JP | 2013227671 | A | 11/2013 |
| JP | 5573265 | B2 | 8/2014 |
| KR | 20090110384 | A | 10/2009 |
| KR | 20120084804 | A | 7/2012 |
| WO | 2015025486 | A1 | 2/2015 |
| WO | 2013089156 | A | 4/2015 |
| WO | 2013190750 | A1 | 2/2016 |

OTHER PUBLICATIONS

Canadian Office Action for Canadian Application No. 2,977,017, dated Aug. 23, 2018, 5 pages.

Chinese Office Action for Chinese Application No. 201680019421.6, dated Aug. 28, 2018, with Concise Statement of Relevance of Office Action, 6 pages.

International Search Report and Written Opinion for International Application PCT/JP2016/001744, dated Jun. 21, 2016—6 Pages.

Korean Office Action for Korean Application No. 10-2017-7027517, dated Dec. 17, 2018, with Concise Statement of Relevance of Office Action, 6 pages.

Korean Office Action for Korean Application No. 10-2017-7027517, dated Jun. 26, 2019 with Concise Statement of Relevance of Office Action, 5 pages.

Korean Office Action for Korean Application No. 10-2017-7027516, dated Jun. 26, 2019 with Concise Statement of Relevance of Office Action, 5 pages.

Non Final Office Action for U.S. Appl. No. 15/562,291, dated May 16, 2019, 12 pages.

European Communication Pursuant to Article 94(3) for European Application No. 16771751.1, dated Dec. 3, 2019, 11 pages.

Notice of Allowance for U.S. Appl. No. 15/562,291, dated Oct. 3, 2019, 21 pages.

* cited by examiner

HIGH-STRENGTH, HIGH-TOUGHNESS STEEL PLATE AND METHOD FOR PRODUCING THE SAME

CROSS REFERENCE TO RELATED APPLICATIONS

This is the U.S. National Phase application of PCT/JP2016/001744, filed Mar. 25, 2016, which claims priority to Japanese Patent Application No. 2015-071932, filed Mar. 31, 2015, the disclosures of these applications being incorporated herein by reference in their entireties for all purposes.

TECHNICAL FIELD OF THE INVENTION

The present invention relates to a high-strength, high-toughness steel plate, and a method for producing the steel plate. Particularly, the invention relates to a high-strength, high-toughness steel plate that has high strength, a high Charpy impact absorbed energy, and excellent DWTT properties and that is suitable as a steel pipe material for a line pipe, and a method for producing the steel plate.

BACKGROUND OF THE INVENTION

Line pipes, which are used for transporting natural gas, crude oil, and the like, have been strongly required to have higher strength in order to improve transport efficiency by using higher pressure and improve on-site welding efficiency by using pipes with thinner walls. In particular, line pipes for transporting high-pressure gas (hereinafter also referred to as high-pressure gas line pipes) are required to have not only material properties such as strength and toughness, which are necessary for general-purpose structural steel, but also material properties related to fracture resistance, which are specific to gas line pipes.

Fracture toughness values of general-purpose structural steel indicate resistance to brittle fracture and are used as indices for making designs so as not to cause brittle fracture during use. For high-pressure gas line pipes, prevention of brittle fracture alone for avoiding catastrophic fracture is not sufficient, and prevention of ductile fracture called unstable ductile fracture is also necessary.

The unstable ductile fracture is a phenomenon where a ductile fracture propagates in a high-pressure gas line pipe in the axial direction of the pipe at a speed of 100 m/s or higher, and this phenomenon can cause catastrophic fracture across several kilometers. Thus, a Charpy impact absorbed energy value and a DWTT (Drop Weight Tear Test) value necessary for preventing unstable ductile fracture are determined from results of past gas burst tests of full-scale pipes, and high Charpy impact absorbed energies and excellent DWTT properties have been demanded. The DWTT value as used herein refers to a fracture appearance transition temperature at which a percent ductile fracture is 85%.

In response to such a demand, Patent Literature 1 discloses a steel plate for steel pipes that has a composition that forms less ferrite in a natural cooling process after rolling, and a method for producing the steel plate. By performing the rolling at an accumulated rolling reduction ratio at 700° C. or lower of 30% or more, the steel plate has a microstructure including a developed texture and composed mainly of bainite, and the area fraction of ferrite present in prior-austenite grain boundaries is 5% or less, so that the steel plate is provided with a high Charpy impact absorbed energy and excellent DWTT properties.

Patent Literature 2 discloses a method for producing a high-strength steel plate having a thickness of 15 mm or less. By rolling a steel containing, by mass %, C: 0.03% to 0.1%, Mn: 1.0% to 2.0%, Nb: 0.01% to 0.1%, P≤0.01%, S≤0.003%, and O≤0.005% in a temperature range from ($Ar_3$+80° C.) to 950° C. at an accumulated rolling reduction ratio of 50% or more, performing natural cooling for a while, and performing rolling in a temperature range from $Ar_3$ to ($Ar_3$−30° C.) at an accumulated rolling reduction ratio of 10% to 30%, the steel plate has an undeveloped rolling texture and deformed ferrite, undergoes no separation, and has a high absorbed energy.

Patent Literature 3 discloses a high-tensile steel plate and a method for producing the steel plate. By subjecting a steel containing, by mass %, C: 0.02% to 0.1%, Si: 0.6% or less, Mn: 1.6% to 2.5%, Ni: 0.1% to 0.7%, Nb: 0.01% to 0.1%, and Ti: 0.005% to 0.03% and having a carbon equivalent Pcm of 0.180% to 0.220% to predetermined continuous casting while suppressing the center segregation of Mn, performing hot rolling under predetermined conditions, performing cooling from a temperature equal to or higher than ($Ar_3$−50° C.) to a temperature range of 300° C. to 500° C. at a cooling rate of 10° C./s to 45° C./s, and optionally performing tempering at a temperature lower than Act temperature, the Martensite-Austenite constituent fraction and hardness of a surface portion are reduced, and the steel plate is provided with high toughness and excellent high-speed ductile fracture properties.

Patent Literature 4 discloses a high-strength, high-toughness steel plate including bainite or martensite, wherein cementite present in the bainite or martensite has an average particle size of 0.5 μm or less. By hot-rolling a steel containing, by mass %, C: 0.03% to 0.12%, Si≤0.5%, Mn: 1.5% to 3.0%, Nb: 0.01% to 0.08%, Ti: 0.005% to 0.025%, and at least one of Cu, Ni, Cr, Mo, V, and B at an accumulated rolling reduction ratio ≥67% in an austenite non-recrystallization temperature range of 950° C. or lower, performing cooling from a cooling start temperature of 600° C. or higher to a temperature range of 250° C. or lower at a cooling rate of 20° C./s to 80° C./s, and performing reheating to 300° C. to 500° C., the steel plate is provided with high resistance to crack by cutting and excellent DWTT properties.

CITATION LIST

Patent Literature

PTL 1: Japanese Unexamined Patent Application Publication No. 2010-222681

PTL 2: Japanese Unexamined Patent Application Publication No. 2003-96517

PTL 3: Japanese Unexamined Patent Application Publication No. 2006-257499

PTL 4: Japanese Unexamined Patent Application Publication No. 2013-057125

SUMMARY OF INVENTION

Technical Problem

In the meantime, a steel plate used for recent high-pressure gas line pipes and the like is required to have higher strength and higher toughness, specifically, a tensile strength of 625 MPa or more, a Charpy impact absorbed energy at −40° C. of 375 J or more, and a percent ductile fracture as determined by a DWTT at −40° C. of 85% or more. In addition to these properties, more excellent surface properties are also required.

In Patent Literature 1, Charpy impact tests in Examples were performed using test specimens taken from a ¼ position in the thickness direction. Thus, the central portion in the thickness direction where cooling after rolling proceeds slowly may have an unsatisfactory microstructure and poor properties, and the steel plate disclosed in Patent Literature 1 may exhibit low unstable ductile fracture arrestability when used as a steel pipe material for a line pipe.

The technique disclosed in Patent Literature 2 involves natural cooling between the rolling in a temperature range from ($Ar_3$+80° C.) to 950° C. at an accumulated rolling reduction ratio of 50% or more and the rolling in a temperature range from $Ar_3$ to ($Ar_3$−30° C.) and thus takes a prolonged rolling time, which may lead to reduced rolling efficiency. In addition, there is no description of DWTT, and brittle fracture arrestability may be poor.

In Patent Literature 3, to reduce the MA (Martensite-Austenite constituent) fraction and hardness of the surface portion, cooling is performed after rolling from a temperature equal to or higher than ($Ar_3$−50° C.) to a temperature range of 300° C. to 500° C. at a cooling rate of 10° C./s to 45° C./s, and tempering is optionally performed at a temperature lower than Act temperature, but when the tempering by heating is not performed, it is necessary to control the temperature after martensite transformation and the subsequent cooling process, and it may be difficult to reliably obtain desired properties. In an example where the tempering by heating was performed (Test No. 9), the 85% FATT as determined by a DWTT was −29° C., which cannot be said to be sufficient for use in an extremely cold region at −40° C. or lower. In the technique disclosed in Patent Literature 3, the microstructure internal to the surface portion is substantially a mixed microstructure composed of ferrite and bainite in order to provide high strength and high toughness. However, an interface between ferrite and bainite may be the initiation site of a ductile crack or a brittle crack. For this reason, the steel plate disclosed in Patent Literature 3 cannot be said to have a Charpy impact absorbed energy sufficient for use in a harsher environment, for example, at −40° C. and may exhibit poor unstable ductile fracture arrestability when used as a steel pipe material for a line pipe. Actually, the steel plate disclosed in Patent Literature 3 is evaluated for Charpy impact absorbed energy at −20° C. and cannot be said to have high-speed ductile fracture properties sufficient for use in an extremely cold region at −40° C. or lower.

In the technique disclosed in Patent Literature 4, to increase strength, the cooling stop temperature is 250° C. or lower so that the steel plate has a bainite or martensite microstructure. However, such a low cooling stop temperature may not only cause cooling distortion that leads to sheet shape degradation but also cause surface defects such as wrinkles and cracks during the manufacture of a steel pipe because a surface portion where cooling proceeds rapidly tends to have excessively high hardness.

The above-described techniques disclosed in Patent Literatures 1 to 4 have not succeeded in stably producing a steel plate having a tensile strength of 625 MPa or more, a Charpy impact absorbed energy at −40° C. of 375 J or more, and a percent ductile fracture as determined by a DWTT at −40° C. of 85% or more as well as sufficient surface properties.

Thus, in view of the above circumstances, an object of the present invention is to provide a high-strength, high-toughness steel plate that includes a base metal having a tensile strength of 625 MPa or more, a Charpy impact absorbed energy at −40° C. of 375 J or more, and a percent ductile fracture (SA value) as determined by a DWTT at −40° C. of 85% or more and that has excellent surface properties, and a method for producing the steel plate.

Solution to Problem

The inventors conducted intensive studies on various factors that affect the Charpy impact absorbed energy, DWTT properties, and surface properties of a steel plate for a line pipe to find out that in producing a steel plate containing C, Mn, Nb, Ti, and other elements, (1) controlling the accumulated rolling reduction ratio and rolling temperature in an austenite non-recrystallization temperature range, (2) properly controlling the cooling start temperature and cooling stop temperature in a cooling process after rolling, (3) properly controlling the temperature drop (ΔT) from cooling start temperature to cooling stop temperature, and (4) performing a reheat treatment under predetermined conditions after cooling, enables a surface portion and a central portion in the thickness direction to each have a microstructure composed mainly of bainite with minimum Martensite-Austenite constituent (hereinafter also referred to as MA), and further enables the average particle size of cementite present in the bainite in the central portion in the thickness direction to be 0.5 μm or less, which results in a high-strength, high-toughness steel plate having a small Vickers hardness difference (ΔHV) between the surface portion and the central portion in the thickness direction, a high Charpy impact absorbed energy, excellent DWTT properties, and excellent surface properties.

The present invention is summarized as described below.

[1] A high-strength, high-toughness steel plate having a composition containing, by mass %, C: 0.03% or more and 0.08% or less, Si: 0.01% or more and 0.50% or less, Mn: 1.5% or more and 2.5% or less, P: 0.001% or more and 0.010% or less, S: 0.0030% or less, Al: 0.01% or more and 0.08% or less, Nb: 0.010% or more and 0.080% or less, Ti: 0.005% or more and 0.025% or less, N: 0.001% or more and 0.006% or less, and further containing at least one selected from Cu: 0.01% or more and 1.00% or less, Ni: 0.01% or more and 1.00% or less, Cr: 0.01% or more and 1.00% or less, Mo: 0.01% or more and 1.00% or less, V: 0.01% or more and 0.10% or less, and B: 0.0005% or more and 0.0030% or less, with the balance being Fe and unavoidable impurities, wherein the steel plate has a microstructure in which an area fraction of Martensite-Austenite constituent in each of a surface portion and a central portion in a thickness direction is less than 3%, an area fraction of bainite in each of the surface portion and the central portion in the thickness direction is 90% or more, and an average particle size of cementite present in the bainite in the central portion in the thickness direction is 0.5 μm or less, and the steel plate has a Vickers hardness difference (ΔHV) between the surface portion and the central portion in the thickness direction of 20 or less.

[2] The high-strength, high-toughness steel plate described in [1] above, wherein the composition further contains, by mass %, at least one selected from Ca: 0.0005% or more and 0.0100% or less, REM: 0.0005% or more and 0.0200% or less, Zr: 0.0005% or more and 0.0300% or less, and Mg: 0.0005% or more and 0.0100% or less.

[3] A method for producing the high-strength, high-toughness steel plate described in [1] or [2] above, the method including heating a steel slab to 1000° C. or higher and 1250° C. or lower, performing rolling in an austenite recrystallization temperature range, performing rolling at an accumulated rolling reduction ratio of 60% or more in an austenite non-recrystallization temperature range, finishing the rolling at a temperature of 770° C. or higher and 850° C. or lower, performing accelerated cooling to achieve a temperature drop (ΔT) of 350° C. or more from a cooling start temperature of 750° C. or higher and 830° C. or lower to a cooling stop temperature of 250° C. or higher and 400° C. or lower at a cooling rate of 10° C./s or more and 80° C./s or less, and then immediately performing reheating to a temperature of 400° C. or higher and 500° C. or lower at a heating rate of 3° C./s or more.

The surface portion as used herein refers to a region extending from a steel plate surface in the thickness direction by 2 mm. The central portion in the thickness direction as used herein refers to a region extending from ⅜ to ⅝ in the thickness direction (a region at a depth from one sheet surface of ⅜ t to ⅝ t, where t is a thickness). In the present invention, every temperature in production conditions is an average steel plate temperature unless otherwise specified. The average steel plate temperature can be determined from thickness, surface temperature, cooling conditions, and other conditions by simulation calculation or other methods. For example, the average temperature of a steel plate can be determined by calculating the temperature distribution in the thickness direction using a difference method. The temperature drop (ΔT) as used herein refers to a difference between a cooling start temperature and a cooling stop temperature.

Advantageous Effects of Invention

According to the present invention, properly controlling the rolling conditions and the cooling conditions after rolling enables a surface portion and a central portion in the thickness direction to each have a steel microstructure composed mainly of bainite and enables the average particle size of cementite present in the bainite in the central portion in the thickness direction to be 0.5 μm or less. This results in a steel plate that has a Vickers hardness difference (ΔHV) between the surface portion and the central portion in the thickness direction of 20 or less and thus has excellent surface properties and that includes a base metal having a tensile strength of 625 MPa or more, a Charpy impact absorbed energy at −40° C. of 375 J or more, and a percent ductile fracture (SA value) as determined by a DWTT at −40° C. of 85% or more, which is industrially extremely useful.

DESCRIPTION OF EMBODIMENTS

The present invention will now be described in detail.

A high-strength, high-toughness steel plate according to the present invention is a steel plate having a composition containing, by mass %, C: 0.03% or more and 0.08% or less, Si: 0.01% or more and 0.50% or less, Mn: 1.5% or more and 2.5% or less, P: 0.001% or more and 0.010% or less, S: 0.0030% or less, Al: 0.01% or more and 0.08% or less, Nb: 0.010% or more and 0.080% or less, Ti: 0.005% or more and 0.025% or less, N: 0.001% or more and 0.006% or less, and further containing at least one selected from Cu: 0.01% or more and 1.00% or less, Ni: 0.01% or more and 1.00% or less, Cr: 0.01% or more and 1.00% or less, Mo: 0.01% or more and 1.00% or less, V: 0.01% or more and 0.10% or less, and B: 0.0005% or more and 0.0030% or less, with the balance being Fe and unavoidable impurities. The steel plate has a microstructure in which in each of a surface portion and a central portion in the thickness direction, the area fraction of Martensite-Austenite constituent is less than 3% and the area fraction of bainite is 90% or more, and in the central portion in the thickness direction, the average particle size of cementite present in the bainite is 0.5 μm or less. The steel plate has a Vickers hardness difference (ΔHV) between the surface portion and the central portion in the thickness direction of 20 or less.

First, reasons for the limitations on the composition of the present invention will be described. It is to be noted that percentages regarding components are by mass %.

C: 0.03% or More and 0.08% or Less

C forms a microstructure composed mainly of bainite after accelerated cooling and is effective in increasing strength through transformation strengthening. However, a C content of less than 0.03% tends to cause ferrite transformation or pearlite transformation during cooling and thus may fail to form a predetermined amount of bainite and provide the desired tensile strength (≥625 MPa). A C content of more than 0.08% tends to form hard martensite after accelerated cooling and may result in a base metal having a low Charpy impact absorbed energy and poor DWTT properties. Thus, the C content is 0.03% or more and 0.08% or less, preferably 0.03% or more and 0.07% or less.

Si: 0.01% or More and 0.50% or Less

Si is an element necessary for deoxidization and further improves steel strength through solid-solution strengthening. To produce such an effect, Si needs to be contained in an amount of 0.01% or more and is preferably contained in an amount of 0.05% or more, still more preferably 0.10% or more. A Si content of more than 0.50% tends to form Martensite-Austenite constituent which may be the initiation site of a ductile crack or a brittle crack, thus resulting in poor weldability and a base metal having a low Charpy impact absorbed energy. Thus, the Si content is 0.01% or more and 0.50% or less. To prevent softening of a weld zone of a steel pipe and a reduction in toughness of a weld heat affected zone of the steel pipe, the Si content is preferably 0.01% or more and 0.20% or less.

Mn: 1.5% or More and 2.5% or Less

Mn, similarly to C, forms a microstructure composed mainly of bainite after accelerated cooling and is effective in increasing strength through transformation strengthening. However, a Mn content of less than 1.5% tends to cause ferrite transformation or pearlite transformation during cooling and thus may fail to form a predetermined amount of bainite and provide the desired tensile strength (≥625 MPa). A Mn content of more than 2.5% results in a concentration of Mn in a segregation part inevitably formed during casting, causing the part to have a low Charpy impact absorbed energy and poor DWTT properties, and thus the Mn content is 1.5% or more and 2.5% or less. To improve toughness, the Mn content is preferably 1.5% or more and 2.0% or less.

P: 0.001% or More and 0.010% or Less

P is an element effective in increasing the strength of the steel plate through solid-solution strengthening. However, a P content of less than 0.001% may not only fail to produce the effect but also cause an increase in dephosphorization cost in a steel-making process, and thus the P content is 0.001% or more. A P content of more than 0.010% results in significantly low toughness and weldability. Thus, the P content is 0.001% or more and 0.010% or less.

S: 0.0030% or Less

S is a harmful element that causes hot brittleness and reduces toughness and ductility by forming sulfide-based inclusions in the steel. Thus, the S content is preferably as low possible. In the present invention, the upper limit of the S content is 0.0030%, preferably 0.0015%. Although there is no lower limit, the S content is preferably at least 0.0001% because an extremely low S content causes an increase in steel-making cost.

Al: 0.01% or More and 0.08% or Less

Al is an element added as a deoxidizer. Al has a solid-solution strengthening ability and thus is effective in increasing the strength of the steel plate. However, an Al content of less than 0.01% may fail to produce the effect. An Al content of more than 0.08% may cause an increase in raw material cost and also reduce toughness. Thus, the Al content is 0.01% or more and 0.08% or less, preferably 0.01% or more and 0.05% or less.

Nb: 0.010% or More and 0.080% or Less

Nb is effective in increasing the strength of the steel plate through precipitation strengthening or a hardenability-improving effect. Nb also widens an austenite non-recrystallization temperature range in hot rolling and is effective in improving toughness through a grain refining effect of rolling in the austenite non-recrystallization range. To produce these effects, Nb is contained in an amount of 0.010% or more. A Nb content of more than 0.080% tends to form hard martensite after accelerated cooling, which may result in a base metal having a low Charpy impact absorbed energy and poor DWTT properties and a HAZ (hereinafter also referred to as a weld heat affected zone) having significantly low toughness. Thus, the Nb content is 0.010% or more and 0.080% or less, preferably 0.010% or more and 0.040% or less.

Ti: 0.005% or More and 0.025% or Less

Ti forms nitrides (mainly TiN) in the steel and, particularly when contained in an amount of 0.005% or more, refines austenite grains through a pinning effect of the nitrides, thus contributing to providing a base metal and a weld heat affected zone with sufficient toughness. In addition, Ti is an element effective in increasing the strength of the steel plate through precipitation strengthening. To produce these effects, Ti is contained in an amount of 0.005% or more. A Ti content of more than 0.025% forms coarse TiN etc., which does not contribute to refining austenite grains and fails to provide improved toughness. In addition, the coarse TiN may be the initiation site of a ductile crack or a brittle crack, thus resulting in a significantly low Charpy impact absorbed energy and significantly poor DWTT properties. Thus, the Ti content is 0.005% or more and 0.025% or less, preferably 0.008% or more and 0.018% or less.

N: 0.001% or More and 0.006% or Less

N forms a nitride together with Ti to inhibit austenite from being coarsened, thus contributing to improving toughness. To produce such a pinning effect, N is contained in an amount of 0.001% or more. A N content of more than 0.006% may result in that when TiN is decomposed in a weld zone, particularly in a weld heat affected zone heated to 1450° C. or higher in the vicinity of a fusion line, solid solute N causes degradation of the toughness of the weld heat affected zone. Thus, the N content is 0.001% or more and 0.006% or less, and when a high level of toughness is required for the weld heat affected zone, the N content is preferably 0.001% or more and 0.004% or less.

In the present invention, in addition to the above-described essential elements, at least one selected from Cu, Ni, Cr, Mo, V, and B is further contained as a selectable element.

Cu: 0.01% or More and 1.00% or Less, Cr: 0.01% or More and 1.00% or Less, Mo: 0.01% or More and 1.00% or Less Cu, Cr, and Mo are all elements for improving hardenability and, similarly to Mn, form a low-temperature transformation microstructure to contribute to providing a base metal and a weld heat affected zone with increased strength. To produce this effect, these elements need to be contained each in an amount of 0.01% or more. However, the strength-increasing effect becomes saturated when the Cu content, the Cr content, and the Mo content are each more than 1.00%. Thus, when Cu, Cr, or Mo is contained, the amount thereof is 0.01% or more and 1.00% or less.

Ni: 0.01% or More and 1.00% or Less

Ni is also an element for improving hardenability and is useful because it causes no reduction in toughness when contained. To produce this effect, Ni needs to be contained in an amount of 0.01% or more. However, Ni is very expensive, and the effect becomes saturated when the Ni content is more than 1.00%. Thus, when Ni is contained, the amount thereof is 0.01% or more and 1.00% or less.

V: 0.01% or More and 0.10% or Less

V is an element that forms a carbide and is effective in increasing the strength of the steel plate through precipitation strengthening. To produce this effect, V needs to be contained in an amount of 0.01% or more. A V content of more than 0.10% may form an excessive amount of carbide to cause a reduction in toughness. Thus, when V is contained, the amount thereof is 0.01% or more and 0.10% or less.

B: 0.0005% or More and 0.0030% or Less

B segregates at austenite grain boundaries to suppress ferrite transformation, thereby contributing to preventing a reduction in strength, particularly of the weld heat affected zone. To produce this effect, B needs to be contained in an amount of 0.0005% or more. However, the effect becomes saturated when the B content is more than 0.0030%. Thus, when B is contained, the amount thereof is 0.0005% or more and 0.0030% or less.

The balance of the composition is Fe and unavoidable impurities, and one or more selected from Ca: 0.0005% or more and 0.0100% or less, REM: 0.0005% or more and 0.0200% or less, Zr: 0.0005% or more and 0.0300% or less, and Mg: 0.0005% or more and 0.0100% or less may be optionally contained.

Ca, REM, Zr, and Mg each have a function to immobilize S in steel to improve the toughness of the steel plate. This effect appears when these elements are contained in an amount of 0.0005% or more. A Ca content of more than 0.0100%, a REM content of more than 0.0200%, a Zr content of more than 0.0300%, or a Mg content of more than 0.0100% may result in increased inclusions in steel, leading to reduced toughness. Thus, when these elements are contained, the amount thereof is as follows: Ca: 0.0005% or more and 0.0100% or less, REM: 0.0005% or more and 0.0200% or less, Zr: 0.0005% or more and 0.0300% or less, Mg: 0.0005% or more and 0.0100% or less.

The microstructure will now be described.

To reliably achieve a Vickers hardness difference (ΔHV) between the surface portion and the central portion in the thickness direction of 20 or less and provide a base metal having a tensile strength of 625 MPa or more, a Charpy impact absorbed energy at −40° C. of 375 J or more, and a percent ductile fracture (SA value) as determined by a DWTT at −40° C. of 85% or more, the microstructure of the high-strength, high-toughness steel plate according to the present invention needs to be a microstructure composed mainly of bainite in which the area fraction of Martensite- Austenite constituent is less than 3% in each of the surface portion and the central portion in the thickness direction and in which the average particle size of cementite present in the bainite in the central portion in the thickness direction is 0.5 μm or less. Here, the microstructure composed mainly of bainite means a microstructure having a bainite area fraction of 90% or more and composed substantially of bainite. The other constituents may include, in addition to the Martensite-Austenite constituent in an area fraction of less than 3%, phases other than bainite, such as ferrite, pearlite, and martensite. The effects of the present invention can be produced if the total area fraction of the other constituents is 10% or less. The surface portion as used herein refers to a region extending from a steel plate surface in the thickness direction by 2 mm. The central portion in the thickness direction as used herein refers to a region extending from ⅜ to ⅝ in the thickness direction (a region at a depth from one sheet surface of ⅜ t to ⅝ t, where t is a thickness).

Martensite-Austenite Constituent Area Fraction in Each of Surface Portion and Central Portion in Thickness Direction: Less than 3%

Martensite-Austenite constituent has high hardness and may be the initiation site of a ductile crack or a brittle crack, and thus a Martensite-Austenite constituent area fraction of 3% or more results in a significantly low Charpy impact absorbed energy and significantly poor DWTT properties. A Martensite-Austenite constituent area fraction of less than 3% will not result in a low Charpy impact absorbed energy or poor DWTT properties, and thus in the present invention, the Martensite-Austenite constituent area fraction is limited to less than 3% in each of the surface portion and the central portion in the thickness direction. The Martensite-Austenite constituent area fraction is preferably 2% or less.

Bainite Area Fraction in Each of Surface Portion and Central Portion in Thickness Direction: 90% or More The bainite is a hard phase and is effective in increasing the strength of the steel plate through transformation microstructure strengthening. The microstructure composed mainly of bainite enables increased strength while stabilizing the Charpy impact absorbed energy and the DWTT properties at high levels. When the bainite area fraction is less than 90%, the total area fraction of the other constituents such as ferrite, pearlite, martensite, and Martensite-Austenite constituent is more than 10%. In such a composite microstructure, an interface among different phases may be the initiation site of a ductile crack or a brittle crack, leading to an insufficient Charpy impact absorbed energy and insufficient DWTT properties. Thus, in the present invention, the bainite area fraction is 90% or more, preferably 95% or more, in each of the surface portion and the central portion in the thickness direction. The bainite as used herein refers to a lath-shaped bainitic ferrite in which cementite particles preciptate.

Average Particle Size of Cementite Present in Bainite in Central Portion in Thickness Direction: 0.5 μm or Less In the central portion in the thickness direction, the cooling speed in accelerated cooling is slower than at the surface or a ¼ position in the thickness direction and thus coarsening of cementite is likely to occur. Cementite in bainite may be the initiation site of a ductile crack or a brittle crack, and an average cementite particle size of more than 0.5 μm results in a significantly low Charpy impact absorbed energy and significantly poor DWTT properties. However, when the average particle size of cementite in bainite in the central portion in the thickness direction is 0.5 μm or less, decreases in these properties are minor and the desired properties can be obtained. Thus, the average cementite particle size is 0.5 μm or less, preferably 0.2 μm or less. At the surface and the ¼ position in the thickness direction, the cooling speed in accelerated cooling is faster than in the central portion in the thickness direction, and the size of cementite is finer, and thus the influence on Charpy impact absorbed energy is small. Thus, in the present invention, the average particle size of cementite in bainite is limited only in the central portion in the thickness direction.

Here, the bainite area fraction of the central portion in the thickness direction can be determined as follows: a sample is taken from the region extending from ⅜ to ⅝ in the thickness direction; an L cross-section (a vertical cross-section parallel to a rolling direction) of the sample is mirror-polished and then etched with nital; five fields of view are randomly selected and observed using a scanning electron microscope (SEM) at a magnification of 2000×; microstructural images are taken to identify a microstructure; and the microstructure is subjected to image analysis to determine the area fraction of phases such as bainite, martensite, ferrite, and pearlite. The Martensite-Austenite constituent area fraction can be determined as follows: the same sample is electrolytically etched (electrolyte: 100 ml of distilled water+25 g of sodium hydroxide+5 g of picric acid) to expose Martensite-Austenite constituent; five fields of view are randomly selected and observed under a scanning electron microscope (SEM) at a magnification of 2000×; and microstructural images taken are subjected to image analysis. The average particle size of cementite can be determined as follows: mirror polishing is performed again; cementite is extracted by selective potentiostatic electrolytic etching by electrolytic dissolution method (electrolyte: 10% by volume acetylacetone+1% by volume tetramethylammonium chloride methyl alcohol); five fields of view are randomly selected and observed using a SEM at a magnification of 2000×; microstructural images taken are subjected to image analysis; and equivalent circle diameters of cementite particles are averaged.

The bainite area fraction and the Martensite-Austenite constituent area fraction of the surface portion are determined by the same method as used for the central portion in the thickness direction described above using a sample taken from a region within 2 mm from a surface except for a surface oxide (scale).

The above-described high-strength, high-toughness steel plate having a high absorbed energy according to the present invention has the following properties.

(1) Vickers hardness difference (ΔHV) between surface portion and central portion in thickness direction of 20 or less: In the surface portion, where cooling after rolling proceeds rapidly, of the steel plate, hard Martensite-Austenite constituent tends to be formed, which leads to an increase in surface hardness. Such an increase in surface hardness may cause surface defects such as wrinkles and cracks during the manufacture of a steel pipe during which stress tends to be concentrated on the steel plate surface. When a steel pipe having such surface defects is used in a high-pressure gas pipeline, the surface defects may be the initiation site of a ductile crack or a brittle crack to cause catastrophic fracture. For this reason, it is important to properly control the hardness of the surface portion. In the present invention, the Vickers hardness difference (ΔHV) between the surface portion and the central portion in the thickness direction is 20 or less, and, preferably, the absolute value of the Vickers hardness of the surface portion is 260 or less. Here, the Vickers hardness of the surface portion is determined as follows: an L cross-section (a vertical cross-section parallel to a rolling direction) of the sample is mechanically polished; in a region within 2 mm from the surface in the thickness direction (the surface portion), Vickers hardness is measured at 10 points under a load of 10 kgf; and the measured values are averaged. The Vickers hardness of the central portion in the thickness direction is determined by performing the same Vickers hardness test at the ½ t position in the thickness direction (the central portion in the thickness direction). In this manner, the Vickers hardness difference (ΔHV) between the two portions is determined.

(2) Base metal tensile strength of 625 MPa or more: Line pipes, which are used for transporting natural gas, crude oil, and the like, have been strongly required to have higher strength in order to improve transport efficiency by using higher pressure and improve on-site welding efficiency by using pipes with thinner walls. To meet such a demand, the tensile strength of a base metal is 625 MPa in the present invention. The tensile strength can be determined by preparing a full-thickness tensile test specimen in accordance with API-5L whose tensile direction is a C direction and performing a tensile test. According to the composition and the microstructure of the present invention, base metal tensile strengths of up to about 850 MPa can be achieved without any problem.

(3) Charpy impact absorbed energy at −40° C. of 375 J or more: A high-pressure gas line pipe is known to experience a high-speed ductile fracture (unstable ductile fracture), which is a phenomenon where a ductile crack due to an external cause propagates in the axial direction of the pipe at a speed of 100 m/s or higher, and this phenomenon can cause catastrophic fracture across several kilometers. A higher absorbed energy effectively prevents such a high-speed ductile fracture, and thus in the present invention, the Charpy impact absorbed energy at −40° C. is 375 J or more, preferably 400 J or more. The Charpy impact absorbed energy at −40° C. can be determined by performing a Charpy impact test in accordance with ASTM A370 at −40° C.

(4) Percent ductile fracture (SA value) as determined by DWTT at −40° C. of 85% or more: Line pipes, which are used for transporting natural gas and the like, are required to have higher percent ductile fracture values as determined by a DWTT in order to prevent brittle crack propagation. In the present invention, the percent ductile fracture (SA value) as determined by a DWTT at −40° C. is 85% or more. The percent ductile fracture (SA value) as determined by a DWTT at −40° C. can be determined from the fractured surface of the sample subjected to an impact bending load to the sample at −40° C. using a drop weight to fracture, where the sample is a press-notched full-thickness DWTT test specimen whose longitudinal direction is a C direction in accordance with API-5L.

A method for producing the high-strength, high-toughness steel plate according to the present invention will now be described.

The method for producing the high-strength, high-toughness steel plate according to the present invention includes heating a steel slab having the above-described composition to 1000° C. or higher and 1250° C. or lower, performing rolling in an austenite recrystallization temperature range, performing rolling at an accumulated rolling reduction ratio of 60% or more in an austenite non-recrystallization temperature range, finishing the rolling at a temperature of 770° C. or higher and 850° C. or lower, performing accelerated cooling to achieve a temperature drop (ΔT) of 350° C. or more from a cooling start temperature of 750° C. or higher and 830° C. or lower to a cooling stop temperature of 250° C. or higher and 400° C. or lower at a cooling rate of 10° C./s or more and 80° C./s or less, and then immediately performing reheating to a temperature of 400° C. or higher and 500° C. or lower at a heating rate of 3° C./s or more. The temperature drop (ΔT) as used herein refers to a difference between a cooling start temperature and a cooling stop temperature.

Slab Heating Temperature: 1000° C. or Higher and 1250° C. or Lower

The steel slab in the present invention is preferably produced by continuous casting in order to prevent macrosegregation of constituents and may also be produced by ingot casting. After the steel slab is produced, (1) a conventional method in which the steel slab is once cooled to room temperature and then reheated, and an energy-saving process such as (2) hot direct rolling in which the hot steel slab left uncooled is charged into a heating furnace and hot-rolled, (3) hot direct rolling in which the steel slab is kept hot for a short period of time and then immediately hot-rolled, or (4) a method in which the steel slab left in a hot state is charged into a heating furnace so that reheating is partially omitted (i.e., hot slab charging) can be employed without any problem.

A heating temperature of lower than 1000° C. may fail to sufficiently dissolve carbides of Nb, V, and other elements in the steel slab and produce a strength-increasing effect of precipitation strengthening. A heating temperature of higher than 1250° C. coarsens initial austenite grains and thus may result in a base metal having a low Charpy impact absorbed energy and poor DWTT properties. Thus, the slab heating temperature is 1000° C. or higher and 1250° C. or lower, preferably. 1000° C. or higher and 1150° C. or lower.

Accumulated Rolling Reduction Ratio in Austenite Recrystallization Temperature Range: 50% or More (Preferred Range)

By performing rolling in an austenite recrystallization temperature range after the slab is heated and held, austenite grains become fine through recrystallization, thereby contributing to improvements in Charpy impact absorbed energy and DWTT properties of a base metal. The accumulated rolling reduction ratio in a recrystallization temperature range is preferably, but not necessarily, 50% or more. Within the steel composition range of the present invention, the lower temperature limit of austenite recrystallization range is approximately 950° C.

Accumulated Rolling Reduction Ratio in Austenite Non-recrystallization Temperature Range: 60% or More By performing rolling in an austenite non-recrystallization temperature range at an accumulated rolling reduction ratio of 60% or more, austenite grains become elongated and become fine particularly in the thickness direction, and performing accelerated cooling to the hot-rolled steel in this state provides a steel having a satisfactory Charpy impact absorbed energy and DWTT properties. A rolling reduction ratio of less than 60% may fail to produce a sufficient grain refining effect, leading to an insufficient Charpy impact absorbed energy and insufficient DWTT properties. Thus, the accumulated-rolling reduction ratio in an austenite non-recrystallization temperature range is 60% or more, and when more improved toughness is required, the accumulated rolling reduction ratio is preferably 70% or more.

Rolling Finish Temperature: 770° C. or Higher and 850° C. or Lower

A heavy rolling reduction at a high accumulated rolling reduction ratio in an austenite non-recrystallization temperature range is effective in improving Charpy impact absorbed energy and DWTT properties, and this effect is further increased by performing a rolling reduction in a lower temperature range. However, rolling in a low-temperature range lower than 770° C. develops a texture in austenite grains, and when accelerated cooling is performed after this to form a microstructure composed mainly of bainite, the texture is partially transferred to the transformed microstructure. This increases the likelihood of separation and leads to a significantly low Charpy impact absorbed energy. Rolling finish temperature higher than 850° C. may fail to produce a sufficient grain refining effect that is effective in improving DWTT properties. Thus, the rolling finish temperature is 770° C. or higher and 850° C. or lower, preferably 770° C. or higher and 820° C. or lower.

Cooling Start Temperature of Accelerated Cooling: 750° C. or Higher and 830° C. or Lower A cooling start temperature of accelerated cooling of lower than 750° C. may lead to the formation of pro-eutectoid ferrite from austenite grain boundaries during a natural cooling process from after hot rolling to the start of accelerated cooling, resulting in low strength of base metal. An increase in pro-eutectoid ferrite formation may increase the number of ferrite-bainite interfaces which may be the initiation site of a ductile crack or a brittle crack, thus resulting in a low Charpy impact absorbed energy and poor DWTT properties. A cooling start temperature of higher than 830° C., which means a high rolling finish temperature, may fail to produce a sufficient microstructure-refining effect that is effective in improving DWTT properties. In addition, a cooling start temperature of higher than 830° C. may facilitate the recovery and growth of austenite grains even if the time of natural cooling from after rolling to the start of accelerated cooling is short, resulting in reduced DWTT properties. Thus, the cooling start temperature of accelerated cooling is 750° C. or higher and 830° C. or lower, preferably 750° C. or higher and 800° C. or lower.

Cooling Rate in Accelerated Cooling: 10° C./s or More and 80° C./s or Less

A cooling rate in accelerated cooling of less than 10° C./s may cause ferrite transformation during cooling, resulting in low strength of base metal. An increase in ferrite formation increases the number of ferrite-bainite interfaces which may be the initiation site of a ductile crack or a brittle crack, which may result in a low Charpy impact absorbed energy and poor DWTT properties. In addition, such a cooling rate in accelerated cooling may facilitate the coagulation and coarsening of cementite in bainite in the central portion in the thickness direction, resulting in a base metal having a low Charpy impact absorbed energy and poor DWTT properties. A cooling rate in accelerated cooling of more than 80° C./s increases Martensite-Austenite constituent and excessively increases surface hardness, particularly near the surface of the steel plate, and thus may fail to provide the desired Vickers hardness difference (ΔHV) between the surface portion and the central portion in the thickness direction, causing surface defects such as wrinkles and cracks during the manufacture of a steel pipe. When a steel pipe having such surface defects is used in a high-pressure gas pipeline, the surface defects may be the initiation site of a ductile crack or a brittle crack to cause catastrophic fracture. Thus, the cooling rate in accelerated cooling is 10° C./s or more and 80° C./s or less. The cooling rate refers to an average cooling rate obtained by dividing a difference between a cooling start temperature and a cooling stop temperature by the time required.

Temperature Drop (Δt) from Cooling Start Temperature to Cooling Stop Temperature: 350° c. or More In the present invention, it is important to control the temperature drop (ΔT) from a cooling start temperature to a cooling stop temperature. As the temperature drop (ΔT) increases, nucleation of bainite is promoted, thus resulting in a finer bainite structure and, furthermore, finer packets and laths, which constitute the bainite. Carbon exists as supersaturated solute carbon in the bainite formed as a result of cooling, and a larger ΔT results in a finer precipitation of the carbon during a heat treatment described below, thus providing a high Charpy impact absorbed energy and excellent DWTT properties. To reliably produce these effects, the ΔT needs to be 350° C. or more and is preferably 400° C. or more. A ΔT of less than 350° C. produces an insufficient microstructure-refining effect and thus may fail to provide the desired Charpy impact absorbed energy and DWTT properties. Thus, the ΔT is 350° C. or more, preferably 400° C. or more. The temperature drop (ΔT) as used herein refers to a difference between a cooling start temperature and a cooling stop temperature.

Cooling Stop Temperature of Accelerated Cooling: 250° C. or Higher and 400° C. or Lower A cooling stop temperature of accelerated cooling of lower than 250° C. may cause martensite transformation, resulting in a base metal having a significantly low Charpy impact absorbed energy and significantly poor DWTT properties although having increased strength. This tendency is strong, particularly near the surface of the steel plate. In addition, such a cooling stop temperature of accelerated cooling tends to excessively increase the hardness of the surface portion where cooling proceeds rapidly and thus may fail to provide the desired Vickers hardness difference (ΔHV) between the surface portion and the central portion in the thickness direction, causing surface defects such as wrinkles and cracks during the manufacture of a steel pipe. Thus, the cooling stop temperature is 250° C. or higher, preferably 255° C. or higher. A cooling stop temperature of higher than 400° C. may fail to provide sufficient strength after the tempering described below and, in addition, may cause cementite in bainite to coagulate and be coarsened, resulting in a base metal having a low Charpy impact absorbed energy and poor DWTT properties. Thus, the cooling stop temperature of accelerated cooling is 250° C. or higher and 400° C. or lower.

Reheat Treatment

In the central portion in the thickness direction, Martensite-Austenite constituent may be formed as a result of the concentration of carbon and alloying elements in untransformed austenite due to bainite transformation during the cooling process. In the surface portion where cooling proceeds relatively rapidly, martensite may be formed in addition to Martensite-Austenite constituent. These hard phases may be the initiation site of a brittle crack or a ductile crack and thus provide a base metal with significantly reduced toughness, and, furthermore, may cause surface defects such as wrinkles and cracks during the manufacture of a steel pipe when the surface hardness is excessively increased. For this reason, it is necessary to properly control the microstructure by reheat treatment to improve toughness of base metal and suppress surface defects. Heating is performed preferably, but not necessarily, by using a high-frequency heating apparatus. Here, performing reheating immediately after accelerated cooling is stopped means that reheating is performed at a heating rate of 3° C./s or more within 120 seconds after accelerated cooling is stopped.

Heating Rate in Reheat Treatment after Accelerated Cooling (Reheating Rate): 3° C./s or More A heating rate in reheating after accelerated cooling of less than 3° C./s may cause cementite in bainite to coagulate and be coarsened, resulting in a base metal having a low Charpy impact absorbed energy and poor DWTT properties. Thus, the heating rate is 3° C./s or more. The upper limit, although not particularly limited, is inevitably limited by the capability of heating means.

Reheating Temperature after Accelerated Cooling: 400° C. or Higher and 500° C. or Lower Hard phases formed after accelerated cooling, such as Martensite-Austenite constituent, martensite, and bainite, reduce toughness of base metal, and thus the toughness of base metal needs to be improved by tempering by reheat treatment. A reheating temperature of lower than 400° C. insufficiently tempers the hard phases such as Martensite-Austenite constituent, martensite, and bainite and thus may fail to improve the toughness of base metal. The hard phases, if left behind in the surface portion, may excessively increase surface hardness and cause surface defects such as wrinkles and cracks during the manufacture of a steel pipe. A reheating temperature in tempering of higher than 500° C. may cause a significant decrease in strength, resulting in insufficient strength of base metal, and, furthermore, may cause cementite in bainite to coagulate and be coarsened, resulting in a base metal having a low Charpy impact absorbed energy and poor DWTT properties. Thus, the reheating temperature after accelerated cooling is 400° C. or higher and 500° C. or lower.

The steel plate of the present invention produced through the rolling process described above is suitable for use as a raw material for a high-strength line pipe. When a high-strength line pipe is produced using the steel plate of the present invention, the steel plate is formed into a substantially cylindrical shape by U-press and O-press, or press bending method which involves repeated three-point bending, and welded, for example, by submerged arc welding to form a welded steel pipe, and the welded steel pipe is expanded into a predetermined shape. The high-strength line pipe thus produced may be surface-coated and/or subjected to a heat treatment for toughness improvement or other purposes, if necessary.

EXAMPLE 1

Examples of the invention will now be described.

Molten steels having compositions (the balance is Fe and unavoidable impurities) shown in Table 1 were each smelted in a converter and cast into a slab having a thickness of 220 mm. The slab was then subjected to hot rolling, accelerated cooling, and reheating after accelerated cooling under conditions shown in Table 2 to produce a steel plate having a thickness of 30 mm.

TABLE 1

| Steel | Composition (mass %) | | | | | | | | | | | | | | | | |
|---|---|---|---|---|---|---|---|---|---|---|---|---|---|---|---|---|---|
| No. | C | Si | Mn | P | S | Al | Nb | Ti | N | Cu | Ni | Cr | Mo | V | B | Others | Notes |
| A | 0.02 | 0.20 | 1.5 | 0.005 | 0.0006 | 0.03 | 0.030 | 0.015 | 0.004 | 0.30 | 0.20 | 0.35 | 0.25 | 0.05 | — | — | Comparative Steel |
| B | 0.04 | 0.20 | 1.9 | 0.005 | 0.0005 | 0.03 | 0.035 | 0.009 | 0.005 | — | — | 0.25 | 0.35 | — | — | REM: 0.0040 | Invention Steel |
| C | 0.05 | 0.20 | 1.9 | 0.006 | 0.0006 | 0.05 | 0.040 | 0.010 | 0.005 | — | — | 0.15 | 0.35 | — | — | Ca: 0.0015 | Invention Steel |
| D | 0.06 | 0.10 | 1.8 | 0.006 | 0.0004 | 0.04 | 0.035 | 0.010 | 0.004 | — | — | 0.20 | 0.30 | — | — | — | Invention Steel |
| E | 0.06 | 0.05 | 1.8 | 0.005 | 0.0005 | 0.03 | 0.015 | 0.015 | 0.003 | — | — | — | 0.35 | — | — | — | Invention Steel |
| F | 0.06 | 0.10 | 1.8 | 0.007 | 0.0008 | 0.03 | 0.035 | 0.015 | 0.004 | 0.40 | 0.20 | — | 0.25 | — | — | — | Invention Steel |
| G | 0.07 | 0.15 | 1.8 | 0.007 | 0.0011 | 0.03 | 0.030 | 0.015 | 0.003 | 0.35 | 0.30 | — | 0.30 | — | — | — | Invention Steel |
| H | 0.08 | 0.20 | 1.7 | 0.008 | 0.0014 | 0.05 | 0.030 | 0.015 | 0.005 | 0.25 | 0.25 | — | — | 0.08 | — | — | Invention Steel |
| I | 0.07 | 0.20 | 2.1 | 0.008 | 0.0021 | 0.06 | 0.040 | 0.010 | 0.005 | 0.35 | 0.35 | — | — | — | — | — | Invention Steel |
| J | 0.05 | 0.40 | 2.4 | 0.007 | 0.0023 | 0.05 | 0.050 | 0.020 | 0.003 | — | — | 0.05 | 0.10 | — | — | Zr: 0.0100 | Invention Steel |
| K | 0.07 | 0.35 | 2.0 | 0.007 | 0.0019 | 0.05 | 0.060 | 0.025 | 0.004 | 0.35 | 0.30 | — | — | — | 0.0030 | Mg: 0.0020 | Invention Steel |
| L | 0.06 | 0.10 | 1.8 | 0.006 | 0.0022 | 0.03 | 0.070 | 0.020 | 0.002 | — | — | 0.25 | 0.30 | — | — | — | Invention Steel |
| M | 0.07 | 0.10 | 1.8 | 0.006 | 0.0017 | 0.02 | 0.060 | 0.020 | 0.005 | 0.40 | 0.20 | — | — | 0.10 | 0.0010 | — | Invention Steel |
| N | 0.04 | 0.15 | 2.3 | 0.005 | 0.0023 | 0.03 | 0.100 | 0.020 | 0.002 | 0.15 | 0.25 | 0.15 | 0.25 | — | — | — | Comparative Steel |
| O | 0.10 | 0.20 | 2.5 | 0.005 | 0.0028 | 0.05 | 0.040 | 0.005 | 0.003 | 0.05 | — | — | — | — | — | — | Comparative Steel |
| P | 0.05 | 0.55 | 2.3 | 0.006 | 0.0023 | 0.03 | 0.060 | 0.005 | 0.003 | 0.15 | 0.15 | — | — | — | — | — | Comparative Steel |
| Q | 0.05 | 0.20 | 2.7 | 0.005 | 0.0006 | 0.03 | 0.020 | 0.010 | 0.003 | 0.05 | 0.05 | — | — | — | — | — | Comparative Steel |
| R | 0.06 | 0.20 | 1.4 | 0.005 | 0.0006 | 0.03 | 0.020 | 0.010 | 0.003 | — | — | 0.25 | 0.25 | — | — | — | Comparative Steel |
| S | 0.05 | 0.20 | 2.1 | 0.005 | 0.0023 | 0.03 | 0.020 | 0.030 | 0.003 | — | — | 0.25 | — | — | — | — | Comparative Steel |
| T | 0.06 | 0.20 | 1.8 | 0.005 | 0.0006 | 0.03 | 0.020 | 0.003 | 0.003 | — | — | — | 0.35 | — | — | — | Comparative Steel |

TABLE 1-continued

| Steel No. | Composition (mass %) C | Si | Mn | P | S | Al | Nb | Ti | N | Cu | Ni | Cr | Mo | V | B | Others | Notes |
|---|---|---|---|---|---|---|---|---|---|---|---|---|---|---|---|---|---|
| U | 0.05 | 0.30 | 2.0 | 0.007 | 0.0023 | 0.06 | 0.005 | 0.020 | 0.003 | — | — | — | 0.10 | — | — | — | Comparative Steel |

The balance of the composition is Fe and unavoidable impurities.

TABLE 2

| Steel Plate No. | Steel No. | Slab Heating Temperature (° C.) | Accumulated Rolling Reduction Ratio in Recrystallization Temperature Range (%) | Accumulated Rolling Reduction Ratio in Non-Recrystallization Temperature Range (%) | Rolling Finish Temperature (° C.) | Cooling Start Temperature (° C.) |
|---|---|---|---|---|---|---|
| 1 | A | 1100 | 54.5 | 70 | 800 | 770 |
| 2 | B | 1100 | 54.5 | 70 | 800 | 770 |
| 3 | C | 1100 | 54.5 | 70 | 800 | 770 |
| 4 | D | 1100 | 54.5 | 70 | 800 | 770 |
| 5 | E | 1100 | 54.5 | 70 | 800 | 770 |
| 6 | F | 1100 | 54.5 | 70 | 800 | 770 |
| 7 | G | 1100 | 54.5 | 70 | 800 | 770 |
| 8 | H | 1100 | 54.5 | 70 | 800 | 770 |
| 9 | I | 1100 | 54.5 | 70 | 800 | 770 |
| 10 | J | 1100 | 54.5 | 70 | 800 | 770 |
| 11 | K | 1100 | 54.5 | 70 | 800 | 770 |
| 12 | L | 1100 | 54.5 | 70 | 800 | 770 |
| 13 | M | 1100 | 54.5 | 70 | 800 | 770 |
| 14 | N | 1100 | 54.5 | 70 | 800 | 770 |
| 15 | O | 1100 | 54.5 | 70 | 800 | 770 |
| 16 | P | 1100 | 54.5 | 70 | 800 | 770 |
| 17 | Q | 1100 | 54.5 | 70 | 800 | 770 |
| 18 | R | 1100 | 54.5 | 70 | 800 | 770 |
| 19 | S | 1100 | 54.5 | 70 | 800 | 770 |
| 20 | T | 1100 | 54.5 | 70 | 800 | 770 |
| 21 | U | 1100 | 54.5 | 70 | 800 | 770 |

| Steel Plate No. | Cooling Rate (° C./s) | Cooling Stop Temperature (° C.) | ΔT*[1] (° C.) | Reheating Rate (° C./s) | Reheating Temperature (° C.) | Notes |
|---|---|---|---|---|---|---|
| 1 | 20 | 350 | 420 | 5 | 450 | Comparative Example |
| 2 | 20 | 350 | 420 | 5 | 450 | Invention Example |
| 3 | 20 | 350 | 420 | 5 | 450 | Invention Example |
| 4 | 20 | 350 | 420 | 5 | 450 | Invention Example |
| 5 | 20 | 350 | 420 | 5 | 450 | Invention Example |
| 6 | 20 | 350 | 420 | 5 | 450 | Invention Example |
| 7 | 20 | 350 | 420 | 5 | 450 | Invention Example |
| 8 | 20 | 350 | 420 | 5 | 450 | Invention Example |
| 9 | 20 | 350 | 420 | 5 | 450 | Invention Example |
| 10 | 20 | 350 | 420 | 5 | 450 | Invention Example |
| 11 | 20 | 350 | 420 | 5 | 450 | Invention Example |
| 12 | 20 | 350 | 420 | 5 | 450 | Invention Example |
| 13 | 20 | 350 | 420 | 5 | 450 | Invention Example |
| 14 | 20 | 350 | 420 | 5 | 450 | Comparative Example |
| 15 | 20 | 350 | 420 | 5 | 450 | Comparative Example |
| 16 | 20 | 350 | 420 | 5 | 450 | Comparative Example |
| 17 | 20 | 350 | 420 | 5 | 450 | Comparative Example |
| 18 | 20 | 350 | 420 | 5 | 450 | Comparative Example |
| 19 | 20 | 350 | 420 | 5 | 450 | Comparative Example |

TABLE 2-continued

| | | | | | | |
|---|---|---|---|---|---|---|
| 20 | 20 | 350 | 420 | 5 | 450 | Comparative Example |
| 21 | 20 | 350 | 420 | 5 | 450 | Comparative Example |

*1Temperature drop from cooling start temperature to cooling stop temperature

A full-thickness tensile test specimen in accordance with API-5L whose tensile direction is a C direction was taken from the steel plate obtained in the above manner and subjected to a tensile test to determine its yield strength (0.5% YS) and tensile strength (TS). A 2 mm V-notched Charpy test specimen whose longitudinal direction was a C direction was taken from the ½ position in the thickness direction and subjected to a Charpy impact test in accordance with ASTM A370 at −40° C. to determine its Charpy impact absorbed energy ($vE_{-40° C.}$). Furthermore, a press-notched full-thickness DWTT test specimen in accordance with API-5L whose longitudinal direction was a C direction was taken, and an impact bending load was applied to the test specimen at −40° C. using a drop weight to determine the percent ductile fracture ($SA_{-40° C.}$) of a fractured surface.

A test specimen for hardness measurement was taken from the steel plate obtained, and an L cross-section (a vertical cross-section parallel to a rolling direction) of the specimen was mechanically polished. In a region within 2 mm from the surface in the thickness direction (the surface portion), Vickers hardness was measured at 10 points under a load of 10 kgf, and the measured values were averaged. Furthermore, the same Vickers hardness test was performed at a ½ t position in the thickness direction (the central portion in the thickness direction) to determine the Vickers hardness difference (ΔHV) between the two portions.

Test specimens for microstructure observation were taken from the region within 2 mm from the surface in the thickness direction (the surface portion) and a region extending from ⅜ to ⅝ in the thickness direction (the central portion in the thickness direction), and in the above-described manner, microstructures were identified, and the area fraction of bainite, Martensite-Austenite constituent, and other constituents and the average particle size of cementite were determined.

Furthermore, surface properties of the steel plates were evaluated as follows: during production of a steel pipe having an outer diameter of 1200 mm (D/t=40), the presence of surface defects such as wrinkles and cracks was visually checked, and steel plates having no surface defects were evaluated as good, and steel plates having any surface defects as poor.

<Microstructure Observation>

A test specimen for microstructure observation was taken from the region extending from ⅜ to ⅝ in the thickness direction (the central portion in the thickness direction) of the steel plate. An L cross-section (a vertical cross-section parallel to a rolling direction) of the specimen was mirror-polished and etched with nital. Five fields of view were randomly selected and observed using a scanning electron microscope (SEM) at a magnification of 2000×. Microstructural images were taken to identify a microstructure. The microstructure was subjected to image analysis to determine the area fraction of phases such as bainite, martensite, ferrite, and pearlite.

Next, the same sample was electrolytically etched (electrolyte: 100 ml of distilled water+25 g of sodium hydroxide+5 g of picric acid) to expose Martensite-Austenite constituent alone. Five fields of view were randomly selected and observed using a SEM at a magnification of 2000×. Microstructural images were taken and subjected to image analysis to determine the Martensite-Austenite constituent area fraction at the ½ position in the thickness direction.

Furthermore, mirror polishing was performed again, and cementite was then extracted by selective potentiostatic electrolytic etching by electrolytic dissolution method (electrolyte: 10% by volume acetylacetone+1% by volume tetramethylammonium chloride methyl alcohol). Five fields of view are randomly selected and observed using a SEM at a magnification of 2000×, and microstructural images taken were subjected to image analysis to determine the average cementite particle size (equivalent circle diameter) at the ½ position in the thickness direction. Meanwhile, a sample was taken from a region within 2 mm from a surface exposed by removing a scale (the surface portion), and the bainite area fraction and the Martensite-Austenite constituent area fraction were determined by the same method as used for the central portion in the thickness direction described above.

The results obtained are shown in Table 3.

TABLE 3

| | | Steel Microstructure | | | | | | | | |
|---|---|---|---|---|---|---|---|---|---|---|
| | | Surface Portion | | | | Central Portion in Thickness Direction | | | | |
| Steel Plate No. | Steel No. | Bainite Area Fraction (%) | Martensite-Austenite Constituent Area Fraction (%) | Other Constituent*1 | Other Constituent Area Fraction (%) | Bainite Area Fraction (%) | Particle Size of Cementite in Bainite (μm) | Martensite-Austenite Constituent Area Fraction (%) | Other Constituent*1 | Other Constituent Area Fraction (%) |
| 1 | A | 87 | 0 | F, P | 13 | 82 | 0.4 | 1 | F | 17 |
| 2 | B | 100 | 0 | — | — | 97 | 0.2 | 1 | F | 2 |
| 3 | C | 100 | 0 | — | — | 97 | 0.2 | 1 | F | 2 |
| 4 | D | 99 | 1 | — | — | 96 | 0.2 | 2 | F | 2 |
| 5 | E | 98 | 1 | F | 2 | 93 | 0.2 | 2 | F | 5 |
| 6 | F | 98 | 0 | F | 2 | 94 | 0.2 | 1 | F | 5 |

TABLE 3-continued

| | | | | | | | | | | |
|---|---|---|---|---|---|---|---|---|---|---|
| 7 | G | 100 | 0 | — | — | 97 | 0.2 | 1 | F | 2 |
| 8 | H | 97 | 1 | F | 2 | 93 | 0.2 | 2 | F | 5 |
| 9 | I | 100 | 0 | — | — | 97 | 0.3 | 1 | F | 2 |
| 10 | J | 100 | 0 | — | — | 98 | 0.2 | 0 | F | 2 |
| 11 | K | 98 | 1 | F | 1 | 95 | 0.2 | 2 | F | 3 |
| 12 | L | 99 | 1 | — | — | 96 | 0.2 | 2 | F | 2 |
| 13 | M | 98 | 0 | F | 2 | 94 | 0.2 | 1 | F | 5 |
| 14 | N | 60 | 0 | M | 40 | 80 | 0.2 | 0 | M | 20 |
| 15 | O | 50 | 0 | M | 50 | 70 | 0.4 | 0 | M | 30 |
| 16 | P | 90 | 6 | M | 4 | 90 | 0.2 | 8 | M | 2 |
| 17 | Q | 55 | 0 | M | 45 | 75 | 0.3 | 0 | M | 25 |
| 18 | R | 87 | 0 | F, P | 13 | 80 | 0.3 | 2 | F | 18 |
| 19 | S | 88 | 0 | F | 2 | 95 | 0.3 | 0 | F | 5 |
| 20 | T | 96 | 1 | F | 3 | 94 | 0.2 | 0 | F | 6 |
| 21 | U | 85 | 0 | F, P | 15 | 78 | 0.2 | 1 | F | 21 |

| Steel | Base Metal Tensile Properties | | Base Metal Toughness | | Hardness | | Base Metal | |
|---|---|---|---|---|---|---|---|---|
| Plate No. | YS (MPa) | TS (MPa) | $vE_{-40° C.}$ (J) | $DWTTSA_{-40° C.}$ (%) | Surface HV | ΔHV*2 | Surface Properties | Notes |
| 1 | 550 | 611 | 405 | 90 | 204 | 7 | Good | Comparative Example |
| 2 | 686 | 762 | 390 | 90 | 254 | 18 | Good | Invention Example |
| 3 | 665 | 739 | 401 | 90 | 246 | 16 | Good | Invention Example |
| 4 | 644 | 715 | 411 | 95 | 238 | 14 | Good | Invention Example |
| 5 | 579 | 643 | 444 | 95 | 214 | 9 | Good | Invention Example |
| 6 | 622 | 691 | 425 | 93 | 230 | 13 | Good | Invention Example |
| 7 | 665 | 739 | 400 | 92 | 246 | 16 | Good | Invention Example |
| 8 | 579 | 643 | 450 | 95 | 214 | 9 | Good | Invention Example |
| 9 | 668 | 742 | 402 | 90 | 247 | 17 | Good | Invention Example |
| 10 | 686 | 762 | 391 | 90 | 254 | 18 | Good | Invention Example |
| 11 | 622 | 691 | 425 | 95 | 230 | 13 | Good | Invention Example |
| 12 | 660 | 733 | 403 | 92 | 244 | 16 | Good | Invention Example |
| 13 | 579 | 643 | 450 | 95 | 214 | 9 | Good | Invention Example |
| 14 | 793 | 881 | 312 | 75 | 294 | 27 | Poor | Comparative Example |
| 15 | 815 | 905 | 202 | 70 | 302 | 29 | Poor | Comparative Example |
| 16 | 625 | 690 | 355 | 80 | 230 | 13 | Good | Comparative Example |
| 17 | 750 | 834 | 310 | 75 | 278 | 23 | Poor | Comparative Example |
| 18 | 511 | 568 | 460 | 95 | 183 | 2 | Good | Comparative Example |
| 19 | 620 | 691 | 360 | 80 | 229 | 12 | Good | Comparative Example |
| 20 | 596 | 655 | 380 | 75 | 214 | 9 | Good | Comparative Example |
| 21 | 533 | 592 | 420 | 80 | 191 | 4 | Good | Comparative Example |

*1F: Ferrite, P: Pearlite, M: Martensite

*2Vickers hardness difference between surface portion and central portion in thickness direction Table 3 shows that steel plates of Nos. 2 to 13, which are Invention Examples where compositions and production methods are in accordance with the present invention, are high-strength, high-toughness steel plates having excellent surface properties and a high absorbed energy, the steel plates each having a Vickers hardness difference (ΔHV) between the surface portion and the central portion in the thickness direction of 20 or less and including a base metal having a tensile strength (TS) of 625 MPa or more, a Charpy impact absorbed energy at −40° C. ($vE_{-40° C.}$) of 375 J or more, and a percent ductile fracture as determined by a DWTT at −40° C. ($SA_{-40° C.}$) of 85% or more.

In contrast, No. 1 and No. 18, which are Comparative Examples, are not provided with the desired tensile strength (TS), because the C content of No. 1 and the Mn content of No. 18 are each below the range of the present invention and then the amount of ferrite and pearlite formed during cooling in the surface portion and the central portion in the thickness direction is large and a predetermined amount of bainite is not formed. No. 14, No. 15, and No. 17, which are Comparative Examples, are not provided with the desired Charpy impact absorbed energy ($vE_{-40°C}$) or the desired DWTT properties ($SA_{-40°C}$), because the Nb content of No. 14, the C content of No. 15, and the Mn content of No. 17 are each over the range of the present invention and then the amount of martensite is increased after reheating after accelerated cooling. In addition, No. 14, No. 15, and No. 17 have inferior surface properties such that surface defects such as wrinkles and cracks occur during the manufacture of a steel pipe because in the surface portion where cooling proceeds rapidly, martensite is formed in a larger amount than in the central portion in the thickness direction, so that the surface hardness is very high, resulting in a Vickers hardness difference (ΔHV) between the surface portion and the central portion in the thickness direction that exceeds a predetermined value. No. 16, which is a Comparative Example, is not provided with the desired Charpy impact absorbed energy ($vE_{-40°C}$) or the desired DWTT properties ($SA_{-40°C}$), because the Si content is over the range of the present invention and then the area fraction of Martensite-Austenite constituent which may be the initiation site of a ductile crack or a brittle crack is large. No. 19, which is a Comparative Example, is not provided with the desired Charpy impact absorbed energy ($vE_{-40°C}$) or the desired DWTT properties ($SA_{-40°C}$), because the Ti content is over the range of the present invention and then TiN is coarsened to be the initiation site of a ductile crack or a brittle crack. No. 20, which is a Comparative Example, is not provided with the desired DWTT properties ($SA_{-40°C}$), because the Ti content is below the range of the present invention and then an austenite grain refining effect of a pinning effect of a nitride (TiN) is not produced. No. 21, which is a Comparative Example, is not provided with the desired DWTT properties ($SA_{-40°C}$), because the Nb content is below the range of the present invention and then a grain refining effect of rolling in a non-recrystallization range is not produced. In addition, No. 21 is not provided with the desired tensile strength (TS) because the amount of ferrite and pearlite formed during cooling is large and a predetermined amount of bainite is not formed.

EXAMPLE 2

Molten steels having compositions of steels D and I (the balance is Fe and unavoidable impurities) shown in Table 1 were each smelted in a converter and cast into a slab having a thickness of 220 mm. The slab was then subjected to hot rolling, accelerated cooling, and reheating after accelerated cooling under conditions shown in Table 4 to produce a steel plate having a thickness of 30 mm.

TABLE 4

| Steel Plate No. | Steel No. | Slab Heating Temperature (° C.) | Accumulated Rolling Reduction Ratio in Recrystallization Temperature Range (%) | Accumulated Rolling Reduction Ratio in Non-Recrystallization Temperature Range (%) | Rolling Finish Temperature (° C.) | Cooling Start Temperature (° C.) | Cooling Rate (° C./s) | Cooling Stop Temperature (° C.) | ΔT*[1] (° C.) | Reheating Rate (° C./s) | Reheating Temperature (° C.) | Notes |
|---|---|---|---|---|---|---|---|---|---|---|---|---|
| 22 | D | 1100 | 54.5 | 70 | 800 | 770 | 20 | 350 | 420 | 5 | 450 | Invention Example |
| 23 | D | 1100 | 54.5 | 70 | 770 | 750 | 20 | 400 | 350 | 3 | 500 | Invention Example |
| 24 | D | 1100 | 54.5 | 70 | 800 | 770 | 20 | 255 | 515 | 5 | 450 | Invention Example |
| 25 | D | 1100 | 54.5 | 70 | 800 | 770 | 20 | 300 | 470 | 5 | 450 | Invention Example |
| 26 | D | 1100 | 65.9 | 60 | 840 | 820 | 20 | 350 | 470 | 5 | 450 | Invention Example |
| 27 | D | 1300 | 54.5 | 70 | 800 | 770 | 20 | 400 | 370 | 5 | 450 | Comparative Example |
| 28 | D | 1100 | 54.5 | 70 | 900 | 850 | 20 | 350 | 500 | 5 | 450 | Comparative Example |
| 29 | D | 950 | 54.5 | 70 | 800 | 770 | 20 | 350 | 420 | 5 | 450 | Comparative Example |
| 30 | D | 1100 | 54.5 | 70 | 730 | 680 | 20 | 300 | 380 | 5 | 450 | Comparative Example |
| 31 | D | 1100 | 54.5 | 70 | 800 | 770 | 5 | 350 | 420 | 5 | 450 | Comparative Example |
| 32 | D | 1100 | 54.5 | 70 | 800 | 770 | 20 | 350 | 420 | 1 | 450 | Comparative Example |
| 33 | D | 1100 | 54.5 | 70 | 800 | 770 | 20 | 350 | 420 | 5 | 550 | Comparative Example |
| 34 | D | 1100 | 54.5 | 70 | 800 | 770 | 20 | 300 | 470 | 5 | 350 | Comparative Example |
| 35 | I | 1100 | 54.5 | 70 | 800 | 770 | 20 | 350 | 420 | 5 | 450 | Invention Example |
| 36 | I | 1100 | 65.9 | 60 | 840 | 820 | 20 | 350 | 470 | 5 | 500 | Invention Example |
| 37 | I | 1050 | 54.5 | 70 | 770 | 750 | 30 | 400 | 350 | 3 | 450 | Invention Example |
| 38 | I | 1100 | 54.5 | 70 | 800 | 770 | 20 | 350 | 420 | 1 | 450 | Comparative Example |

TABLE 4-continued

| Steel Plate No. | Steel No. | Slab Heating Temperature (° C.) | Accumulated Rolling Reduction Ratio in Recrystallization Temperature Range (%) | Accumulated Rolling Reduction Ratio in Non-Recrystallization Temperature Range (%) | Rolling Finish Temperature (° C.) | Cooling Start Temperature (° C.) | Cooling Rate (° C./s) | Cooling Stop Temperature (° C.) | ΔT*1 (° C.) | Reheating Rate (° C./s) | Reheating Temperature (° C.) | Notes |
|---|---|---|---|---|---|---|---|---|---|---|---|---|
| 39 | I | 1100 | 54.5 | 70 | 800 | 770 | 20 | 550 | 220 | 5 | 570 | Comparative Example |
| 40 | I | 1100 | 54.5 | 70 | 800 | 770 | 100 | 350 | 420 | 5 | 450 | Comparative Example |
| 41 | I | 1100 | 54.5 | 70 | 800 | 770 | 20 | 230 | 540 | 5 | 450 | Comparative Example |

*1Temperature drop from cooling start temperature to cooling stop temperature

The steel plates obtained in the above manner were subjected to a full-thickness tensile test, a Charpy impact test, and a press-notched full-thickness DWTT in the same manner as in Example 1 to determine their yield strength (0.5% YS), tensile strength (TS), Charpy impact absorbed energy ($vE_{-40° C.}$), percent ductile fracture ($SA_{-40° C.}$), and Vickers hardness.

The results obtained are shown in Table 5.

TABLE 5

| | | Steel Microstructure | | | | | | | | |
|---|---|---|---|---|---|---|---|---|---|---|
| | | Surface Portion | | | | Central Portion in Thickness Direction | | | | |
| Steel Plate No. | Steel No. | Bainite Area Fraction (%) | Martensite-Austenite Constituent Area Fraction (%) | Other Constituent*1 | Other Constituent Area Fraction (%) | Bainite Area Fraction (%) | Particle Size of Cementite in Bainite | Martensite-Austenite Constituent Area Fraction (%) | Other Constituent*1 | Other Constituent Area Fraction (%) |
| 22 | D | 99 | 1 | — | — | 96 | 0.2 | 2 | F | 2 |
| 23 | D | 92 | 0 | F | 8 | 95 | 0.5 | 0 | F | 5 |
| 24 | D | 99 | 1 | — | — | 98 | 0.2 | 1 | F | 1 |
| 25 | D | 99 | 1 | — | — | 97 | 0.2 | 1 | F | 2 |
| 26 | D | 99 | 1 | — | — | 96 | 0.2 | 2 | F | 2 |
| 27 | D | 99 | 1 | — | — | 96 | 0.2 | 2 | F | 2 |
| 28 | D | 99 | 1 | — | — | 95 | 0.2 | 2 | F | 3 |
| 29 | D | 92 | 1 | F | 7 | 95 | 0.2 | 0 | F | 5 |
| 30 | D | 70 | 0 | F | 30 | 80 | 0.1 | 0 | F | 20 |
| 31 | D | 79 | 1 | F, P | 20 | 84 | 0.1 | 1 | F, P | 15 |
| 32 | D | 99 | 1 | — | — | 96 | 0.9 | 2 | F | 2 |
| 33 | D | 98 | 2 | — | — | 96 | 1.2 | 2 | F | 2 |
| 34 | D | 99 | 1 | — | — | 96 | 0.2 | 2 | F | 2 |
| 35 | I | 100 | 0 | — | — | 97 | 0.3 | 1 | F | 2 |
| 36 | I | 96 | 0 | F | 4 | 93 | 0.5 | 1 | F | 6 |
| 37 | I | 98 | 0 | F | 2 | 95 | 0.2 | 1 | F | 4 |
| 38 | I | 96 | 0 | F | 4 | 92 | 1.2 | 0 | F | 8 |
| 39 | I | 95 | 0 | F | 5 | 94 | 1.5 | 0 | F | 6 |
| 40 | I | 72 | 0 | M | 28 | 80 | 0.1 | 0 | M | 20 |
| 41 | I | 59 | 1 | M | 40 | 75 | 0.2 | 1 | M | 24 |

| Steel | Base Metal Tensile Properties | | Base Metal Toughness | | Base Metal Hardness | | | |
|---|---|---|---|---|---|---|---|---|
| Plate No. | YS (MPa) | TS (MPa) | $vE_{-40° C.}$ (J) | $DWTTSA_{-40° C.}$ (%) | Surface HV | ΔHV*2 | Surface Properties | Notes |
| 22 | 644 | 715 | 411 | 95 | 238 | 14 | Good | Invention Example |
| 23 | 629 | 699 | 400 | 90 | 233 | 13 | Good | Invention Example |
| 24 | 653 | 725 | 425 | 95 | 245 | 16 | Good | Invention Example |
| 25 | 648 | 720 | 417 | 95 | 242 | 15 | Good | Invention Example |
| 26 | 639 | 710 | 400 | 90 | 237 | 14 | Good | Invention Example |

TABLE 5-continued

| | | | | | | | | |
|---|---|---|---|---|---|---|---|---|
| 27 | 617 | 685 | 400 | 75 | 228 | 12 | Good | Comparative Example |
| 28 | 630 | 700 | 380 | 80 | 233 | 13 | Good | Comparative Example |
| 29 | 555 | 610 | 440 | 90 | 203 | 7 | Good | Comparative Example |
| 30 | 470 | 550 | 280 | 90 | 183 | 2 | Good | Comparative Example |
| 31 | 539 | 590 | 450 | 95 | 197 | 5 | Good | Comparative Example |
| 32 | 640 | 710 | 385 | 80 | 237 | 14 | Good | Comparative Example |
| 33 | 620 | 700 | 370 | 75 | 233 | 13 | Good | Comparative Example |
| 34 | 680 | 755 | 365 | 80 | 262 | 25 | Poor | Comparative Example |
| 35 | 668 | 742 | 402 | 95 | 247 | 17 | Good | Invention Example |
| 36 | 662 | 735 | 388 | 85 | 245 | 16 | Good | Invention Example |
| 37 | 666 | 740 | 395 | 90 | 247 | 16 | Good | Invention Example |
| 38 | 621 | 690 | 350 | 80 | 230 | 13 | Good | Comparative Example |
| 39 | 550 | 610 | 420 | 80 | 203 | 7 | Good | Comparative Example |
| 40 | 698 | 802 | 250 | 75 | 297 | 28 | Poor | Comparative Example |
| 41 | 704 | 815 | 360 | 80 | 285 | 25 | Poor | Comparative Example |

*[1]F: Ferrite, P: Pearlite, M: Martensite
*[2]Vickers hardness difference between surface portion and central portion in thickness direction Table 5 shows that steel plates of Nos. 22 to 26 and 35 to 37 satisfying the production conditions of the present invention, which are Invention Examples where compositions and production methods are in accordance with the present invention, are high-strength, high-toughness steel plates having excellent surface properties and a high absorbed energy, the steel plates each having a Vickers hardness difference (ΔHV) between the surface portion and the central portion in the thickness direction of 20 or less and including a base metal having a tensile strength (TS) of 625 MPa or more, a Charpy impact absorbed energy at −40° C. ($vE_{-40°\ C.}$) of 375 J or more, and a percent ductile fracture as determined by a DWTT at −40° C. ($SA_{-40°\ C.}$) of 85% or more. Among the steel plates having the same composition, Nos. 22, 24, and 25 are superior in Charpy impact absorbed energy ($vE_{-40°\ C.}$) and percent ductile fracture ($SA_{-40°\ C.}$) because the accumulated rolling reduction ratio in a non-recrystallization temperature range, the rolling finish temperature, the cooling start temperature, and the temperature drop (ΔT) from a cooling start temperature to a cooling stop temperature are each in a preferred range, so that bainite grains are refined and supersaturated solute carbon in the bainite formed by transformation as a result of accelerated cooling is finely precipitated during reheat treatment. The properties of No. 36 are slightly inferior to those of No. 35 because the accumulated rolling reduction ratio in a non-recrystallization temperature range, the rolling finish temperature, and the cooling start temperature are not in preferred ranges, although the ΔT is in a preferred range.

In contrast, No. 27, which is a Comparative Example, is not provided with the desired DWTT properties ($SA_{-40°\ C.}$), because the slab heating temperature is over the range of the present invention and then initial austenite grains are coarsened. No. 28, which is a Comparative Example, is not provided with the desired DWTT properties ($SA_{-40°\ C.}$), because the rolling finish temperature and the cooling start temperature, which varies with the rolling finish temperature, are each over the range of the present invention, and then a grain refining effect that is effective in improving DWTT properties is not sufficiently produced. No. 29, which is a Comparative Example, is not provided with the desired tensile strength (TS), because the slab heating temperature is below the range of the present invention and then carbides of Nb, V, and other elements in a steel slab are not sufficiently dissolved, and a strength-increasing effect of precipitation strengthening is not produced. No. 30, which is a Comparative Example, is not provided with the desired tensile strength (TS), because the rolling finish temperature and the cooling start temperature are each below the range of the present invention and then the amount of ferrite formed during rolling or during cooling is large and a predetermined amount of bainite is not formed. In addition, No. 30 is not provided with the desired Charpy impact absorbed energy ($vE_{-40°\ C.}$) because separation occurs under the influence of a texture developed during rolling. No. 31, which is a Comparative Example, is not provided with the desired tensile strength (TS), because the cooling rate in accelerated cooling is below the range of the present invention and then the amount of ferrite and pearlite formed during cooling is large and a predetermined amount of bainite is not formed. No. 32, which is a Comparative Example, is not provided with the desired DWTT properties ($SA_{-40°\ C.}$), because the heating rate in reheating is below the range of the present invention and then cementite in bainite coagulates and is coarsened. No. 33, which is a Comparative Example, is not provided with the desired Charpy impact absorbed energy ($vE_{-40°\ C.}$) or the desired DWTT properties ($SA_{-40°\ C.}$), because the reheating temperature is over the range of the present invention and then cementite in bainite coagulates and is coarsened. No. 34, which is a Comparative Example, is not provided with the desired Charpy impact absorbed energy ($vE_{-40°\ C.}$) or the desired DWTT properties ($SA_{-40°\ C.}$), because the reheating temperature is below the range of the present invention and then the tempering effect of reheat treatment is insufficient. In addition, No. 34 is not provided with the desired surface properties because of increased surface hardness due to hard phases such as Martensite-Austenite constituent remaining in the surface portion. No. 38, which is a Comparative Example, is not provided with the desired Charpy impact absorbed energy ($vE_{-40°C.}$) or the desired DWTT properties ($SA_{-40°C.}$), because the heating rate in reheating is below the range of the present invention and then cementite in bainite coagulates and is coarsened. No. 39, which is a Comparative Example, is not provided with the desired tensile strength (TS) or the desired DWTT properties ($SA_{-40°C.}$), because the cooling stop temperature is over the range of the present invention and the reheating temperature is over the range of the present invention and then cementite in bainite coagulates and is coarsened. In addition, No. 39 is not provided with the desired DWTT properties ($SA_{-40°C.}$) also because the temperature drop (ΔT) is less than 350° C. No. 40, which is a Comparative Example, is not provided with the desired Charpy impact absorbed energy ($vE_{-40°C.}$) or the desired DWTT properties ($SA_{-40°C.}$), because the cooling rate in accelerated cooling is over the range of the present invention and then the amount of hard martensite formation is increased after accelerated cooling. In addition, No. 40 is not provided with the desired surface properties because of increased surface hardness due to hard martensite remaining in the surface portion. No. 41, which is a Comparative Example, is not provided with the desired Charpy impact absorbed energy ($vE_{-40°C.}$) or the desired DWTT properties ($SA_{-40°C.}$), because the cooling stop temperature is below the range of the present invention and then the amount of martensite formation after accelerated cooling is increased. In addition, No. 41 is not provided with the desired surface properties because of increased surface hardness due to hard martensite remaining in the surface portion.

INDUSTRIAL APPLICABILITY

Using the high-strength, high-toughness steel plate having a high absorbed energy according to the present invention for a line pipe, which is used for transporting natural gas, crude oil, and the like, can greatly contribute to improving transport efficiency by using higher pressure and to improving on-site welding efficiency by using pipes with thinner walls.

The invention claimed is:

1. A high-strength, high-toughness steel plate having a composition containing, by mass %, C: 0.03% or more and 0.08% or less,
Si: 0.01% or more and 0.50% or less,
Mn: 1.5% or more and 2.5% or less,
P: 0.001% or more and 0.010% or less,
S: 0.0030% or less,
Al: 0.01% or more and 0.08% or less,
Nb: 0.010% or more and 0.080% or less,
Ti: 0.005% or more and 0.025% or less,
N: 0.001% or more and 0.006% or less,
and further containing at least one selected from
Cu: 0.01% or more and 1.00% or less,
Ni: 0.01% or more and 1.00% or less,
Cr: 0.01% or more and 1.00% or less,
Mo: 0.01% or more and 1.00% or less,
V: 0.01% or more and 0.10% or less, and
B: 0.0005% or more and 0.0030% or less,
with the balance being Fe and unavoidable impurities,
wherein the steel plate has a microstructure in which an area fraction of Martensite-Austenite constituent in each of a surface portion and a central portion in a thickness direction is less than 3%, an area fraction of bainite in each of the surface portion and the central portion in the thickness direction is 90% or more, and an average particle size of cementite present in the bainite in the central portion in the thickness direction is 0.5 μm or less, and
the steel plate has a Vickers hardness difference (ΔHV) between the surface portion and the central portion in the thickness direction of 20 or less.

2. The high-strength, high-toughness steel plate according to claim 1, wherein the composition further contains, by mass %, at least one selected from Ca: 0.0005% or more and 0.0100% or less,
REM: 0.0005% or more and 0.0200% or less,
Zr: 0.0005% or more and 0.0300% or less, and
Mg: 0.0005% or more and 0.0100% or less.

3. A method for producing the high-strength, high-toughness steel plate according to claim 1, the method comprising:

heating a steel slab to 1000° C. or higher and 1250° C. or lower;
performing rolling in an austenite recrystallization temperature range;
performing rolling at an accumulated rolling reduction ratio of 60% or more in an austenite non-recrystallization temperature range;
finishing the rolling at a temperature of 770° C. or higher and 850° C. or lower;
performing accelerated cooling to achieve a temperature drop (ΔT) of 350° C. or more from a cooling start temperature of 750° C. or higher and 830° C. or lower to a cooling stop temperature of 250° C. or higher and 400° C. or lower at a cooling rate of 10° C./s or more and 80° C./s or less; and then
immediately performing reheating to a temperature of 400° C. or higher and 500° C. or lower at a heating rate of 3° C./s or more.

4. A method for producing the high-strength, high-toughness steel plate according to claim 2, the method comprising:

heating a steel slab to 1000° C. or higher and 1250° C. or lower;
performing rolling in an austenite recrystallization temperature range;
performing rolling at an accumulated rolling reduction ratio of 60% or more in an austenite non-recrystallization temperature range;
finishing the rolling at a temperature of 770° C. or higher and 850° C. or lower;
performing accelerated cooling to achieve a temperature drop (ΔT) of 350° C. or more from a cooling start temperature of 750° C. or higher and 830° C. or lower to a cooling stop temperature of 250° C. or higher and 400° C. or lower at a cooling rate of 10° C./s or more and 80° C./s or less; and then
immediately performing reheating to a temperature of 400° C. or higher and 500° C. or lower at a heating rate of 3° C./s or more.

* * * * *